US009283606B2

(12) United States Patent
Oka et al.

(10) Patent No.: US 9,283,606 B2
(45) Date of Patent: Mar. 15, 2016

(54) METHOD OF MANUFACTURING SUPPORTING STRUCTURE, SWAGING JIG FOR USE THEREIN AND THE SUPPORTING STRUCTURE

(71) Applicant: OTICS CORPORATION, Nishio-shi, Aichi (JP)

(72) Inventors: Hideki Oka, Handa (JP); Hiroki Fujii, Aichi (JP); Kazunori Kawahara, Nishio (JP); Haruyasu Tanaka, Nishio (JP)

(73) Assignee: OTICS CORPORATION, Nishio-Shi, Aichi (JP)

( * ) Notice: Subject to any disclaimer, the term of this patent is extended or adjusted under 35 U.S.C. 154(b) by 378 days.

(21) Appl. No.: 13/740,749

(22) Filed: Jan. 14, 2013

(65) Prior Publication Data

US 2013/0192047 A1 Aug. 1, 2013

(30) Foreign Application Priority Data

Jan. 26, 2012 (JP) ..... 2012-013860

(51) Int. Cl.
*B21D 9/00* (2006.01)
*F01L 1/18* (2006.01)

(52) U.S. Cl.
CPC . *B21D 9/00* (2013.01); *F01L 1/181* (2013.01); *F01L 2103/00* (2013.01); *F01L 2105/00* (2013.01); *Y10T 29/49908* (2015.01)

(58) Field of Classification Search
CPC ..... B21D 9/00; F01L 1/181; F01L 2105/00; F01L 2103/00; F01L 1/185; F01L 2105/02; F01L 1/267; Y10T 29/49908
See application file for complete search history.

(56) References Cited

U.S. PATENT DOCUMENTS 4,969,261 A 11/1990 Igarashi
5,054,440 A * 10/1991 Kadokawa ..... 123/90.5

(Continued)

FOREIGN PATENT DOCUMENTS

DE 43 37 594 A1 5/1995
GB 2 233 418 A 1/1991

(Continued)

OTHER PUBLICATIONS

Merriam-Webster Defintion of Petaline.*

(Continued)

*Primary Examiner* — David Bryant
*Assistant Examiner* — Lee A Holly
(74) *Attorney, Agent, or Firm* — Smith, Gambrell & Russell, LLP

(57) ABSTRACT

A method of manufacturing a supporting structure includes disposing a supported member between a pair of opposed support walls, the support walls and the supported member having shaft holes formed coaxially through the support walls and the supported member respectively, inserting a shaft member through the shaft holes in the disposed state, the shaft member having two ends each having a peripheral portion circumferentially divided into a plurality of swaging portions continuous without discontinuity and swaging the swaging portions sequentially such that regions of the shaft member corresponding to the respective swaging portions are fixed in the shaft holes. The swaging portions include first swaging portions and second swaging portions, both of which are disposed so as to be paired at both radial sides of the shaft holes, respectively. A larger swage load is applied to each first swaging portion than to each second swaging portion.

5 Claims, 6 Drawing Sheets

(56) References Cited

U.S. PATENT DOCUMENTS

| | | | | |
|---|---|---|---|---|
| 5,099,807 | A | 3/1992 | Devine | |
| 5,375,323 | A | 12/1994 | Sata | |
| PP9,065 | P * | 2/1995 | Evers | Plt./134 |
| 2011/0005073 | A1 * | 1/2011 | Meisborn et al. | 29/888.03 |
| 2015/0016869 | A1 * | 1/2015 | Suzuki | 403/154 |

FOREIGN PATENT DOCUMENTS

| | | | |
|---|---|---|---|
| JP | S64-034406 | | 3/1989 |
| JP | H03-92509 | U | 9/1991 |
| JP | H05-169164 | | 7/1993 |
| JP | 6-74006 | A | 3/1994 |
| JP | 11-188435 | A | 7/1999 |
| JP | 2006-336520 | A | 12/2006 |
| JP | 2006336520 | A * | 12/2006 |
| JP | 2007-321915 | | 12/2007 |
| JP | 2008-75481 | | 4/2008 |

OTHER PUBLICATIONS

Machine translation of JP 2006 336520.*

Extended European Search Report date Jul. 4, 2013 for Application No. EP 13 00 0084.7.

Japanese Office Action mailed Apr. 14, 2015 concerning Japanese Patent Application 2012-013860 (in Japanese with English translation) 8 pages.

* cited by examiner (A)

(B)

METHOD OF MANUFACTURING SUPPORTING STRUCTURE, SWAGING JIG FOR USE THEREIN AND THE SUPPORTING STRUCTURE

CROSS-REFERENCE TO RELATED APPLICATIONS

This application is based upon and claims the benefit of priority from the prior Japanese Patent Application No. 2012-13860 filed on Jan. 26, 2012, the entire contents of which are incorporated herein by reference.

BACKGROUND OF THE INVENTION

1. Field of the Invention

The present invention relates to a method of manufacturing a supporting structure, a swaging jig for use in the manufacturing method, and the supporting structure.

2. Description of the Related Art

Japanese Patent Application Publication No. JP-A-2008-75481 discloses a supporting structure which supports a roller as a supported body between a pair of support walls opposed to each other. Both support walls and the roller are formed with coaxial through shaft holes respectively. A shaft member is sequentially inserted through the shaft holes. The shaft member has two ends facing outer surfaces of the support walls respectively. A punch serving as a swaging jig is driven into peripheral edges of the ends of the shaft member, whereby the shaft member is swaged thereby to be fixed in the shaft holes of the support walls. The punch has a distal end formed with an annular protrusion. The protrusion applies a substantially constant swage load to overall peripheral edges of both ends of the shaft member.

In the above-described case, when the peripheral edges of both ends of the shaft member are deformed so as to be spread with drive of the punch into the peripheral edges, there is a possibility that both support walls may also be deformed with deformation of both shaft end peripheral edges. In view of this drawback, the above-mentioned document provides a structure in which a connecting member connects between distal ends of both support walls so that the support walls are hard to deform. However, since the connecting member is added to the existing construction, the whole structure is complicated.

BRIEF SUMMARY OF THE INVENTION

Therefore, an object of the present invention is to prevent the support walls from deforming without complicating the whole supporting structure.

In one aspect, the present invention provides a method of manufacturing a supporting structure comprising disposing a supported member between a pair of support walls opposed to each other, the support walls and the supported member having shaft holes formed coaxially through the support walls and the supported member respectively; inserting a shaft member through the shaft holes in the disposed state, the shaft member having two ends each of which has a peripheral portion circumferentially divided into a plurality of swaging portions continuous without discontinuity; and swaging the swaging portions sequentially such that regions of the shaft member corresponding to the respective swaging portions are fixed in the shaft holes of the respective support walls.

In another aspect, the invention provides a supporting structure comprising a pair of support walls opposed to each other with a supported member being interposed therebetween, the support walls and the supported member having shaft holes formed coaxially through the support walls and the support member respectively; and a shaft member inserted through the respective shaft holes of the support walls and the supported member, wherein the shaft member has two ends each of which has a peripheral portion circumferentially divided into a plurality of swaging portions which are sequentially swaged such that regions of the shaft member corresponding to the respective swaging portions are fixed in the shaft holes of the respective support walls. The corresponding regions of the swaging portions have outer peripheral edges which are formed into shapes differing from a complete circle over entire circumferences respectively.

According to the above-described method and structure, when the circumferentially divided swaging portions in both end peripheral portions of the shaft member are sequentially swaged, the swage load necessary to fix the shaft member to the support walls by swaging is divided by the swaging process. Consequently, the swage load necessary in each swaging process can be reduced. Accordingly, a deforming force transmitted from each swaging portion to both support walls is reduced as compared with the conventional case where a large swage load is applied to both end peripheries of the shaft member by only one swaging process. Consequently, both support walls can be prevented from deformation without complicating the whole construction.

In one embodiment, the support walls have respective hardly-deformable portions and respective easily-deformable portions having shorter distances from peripheral edges of the support walls to the shaft holes and smaller section modulus than the hardly-deformable portions, and a swage load applied to the swaging portions located opposite the hardly-deformable portions is larger than a swage load applied to the swaging portions located opposite the easily-deformable portions, respectively. Furthermore, each swaging portion located opposite the hardly-deformable portion has an impression of a groove deeper than each swaging portion located opposite the easily-deformable portion. Consequently, a requisite swage strength as a whole can be obtained with deformation of the easily-deformable portions being suppressed. Furthermore, since each hardly-deformable portion has a larger section modulus, the peripheries of the support walls can hardly be influenced by the swage load even when a larger swage load is applied to each swaging portion located opposite the hardly-deformable portion. Consequently, the peripheries of the support walls can be prevented from deformation.

In further another embodiment, a swaging jig which is used in the method of manufacturing the supporting structure has a pair of protrusions to form the swaging portions and the protrusions are each formed into an arc shape. Consequently, a generally annular impression can be obtained by circumferentially continuous provision of the swaging portions as in the conventional construction.

DETAILED DESCRIPTION OF THE EMBODIMENTS

An embodiment of the invention will be described with reference to FIGS. 1 to 6B. The embodiment exemplifies a supporting structure for a roller 10 of a rocker arm 60.

Figure 1:
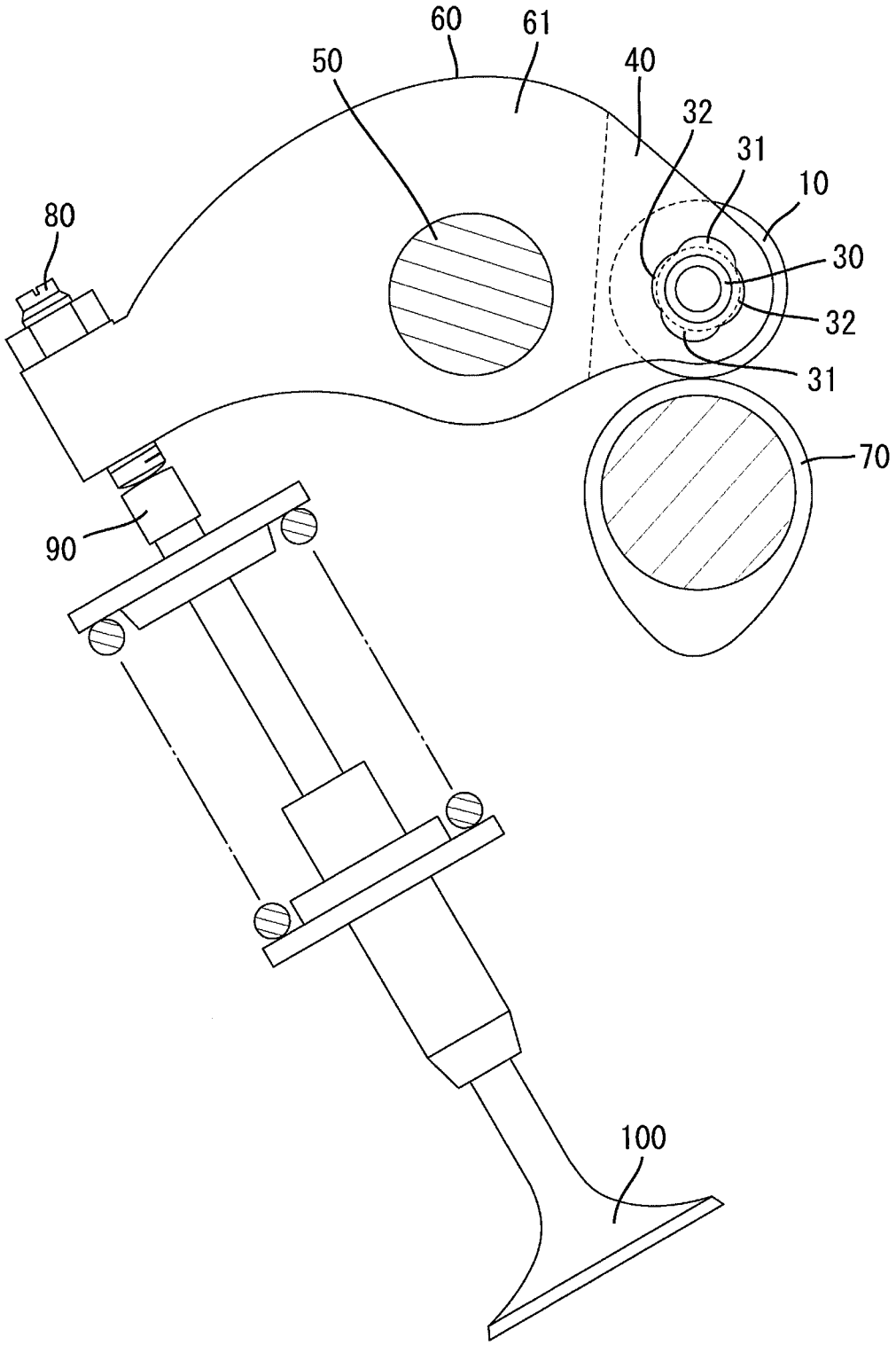
FIG. 1 is a schematic side elevation of a rocker arm to which a supporting structure of an embodiment is applied, showing a usage state.

Referring to FIG. 1, the rocker arm 60 includes an arm body 61 extending in a front-back direction with respect thereto. The roller 10 is rotatably supported on a front end of the arm body 61 and is in abutment with a cam 70 from above. The roller 10 thus serves as a supported member. The arm body 61 has a rear end on which an adjusting screw 80 is mounted. The adjusting screw 80 is in abutment with a valve stem 90 from above. The arm body 61 has a middle portion with respect to the front-back direction, which portion has a through hole (not shown) through which a support shaft 50 extends in a right-left direction that is perpendicular to the above-mentioned front-back direction and is the same as an axial direction of a shaft member which will be described later.

Upon rotation of the cam 70, the roller 10 is rotated to swing the arm body 61 in such a direction that front and rear ends of the arm body 61 are moved up and down about the support shaft 50. With the swing of the arm body 61, the valve stem 90 is vertically reciprocated thereby to open and close a valve element 100.

Figure 3:
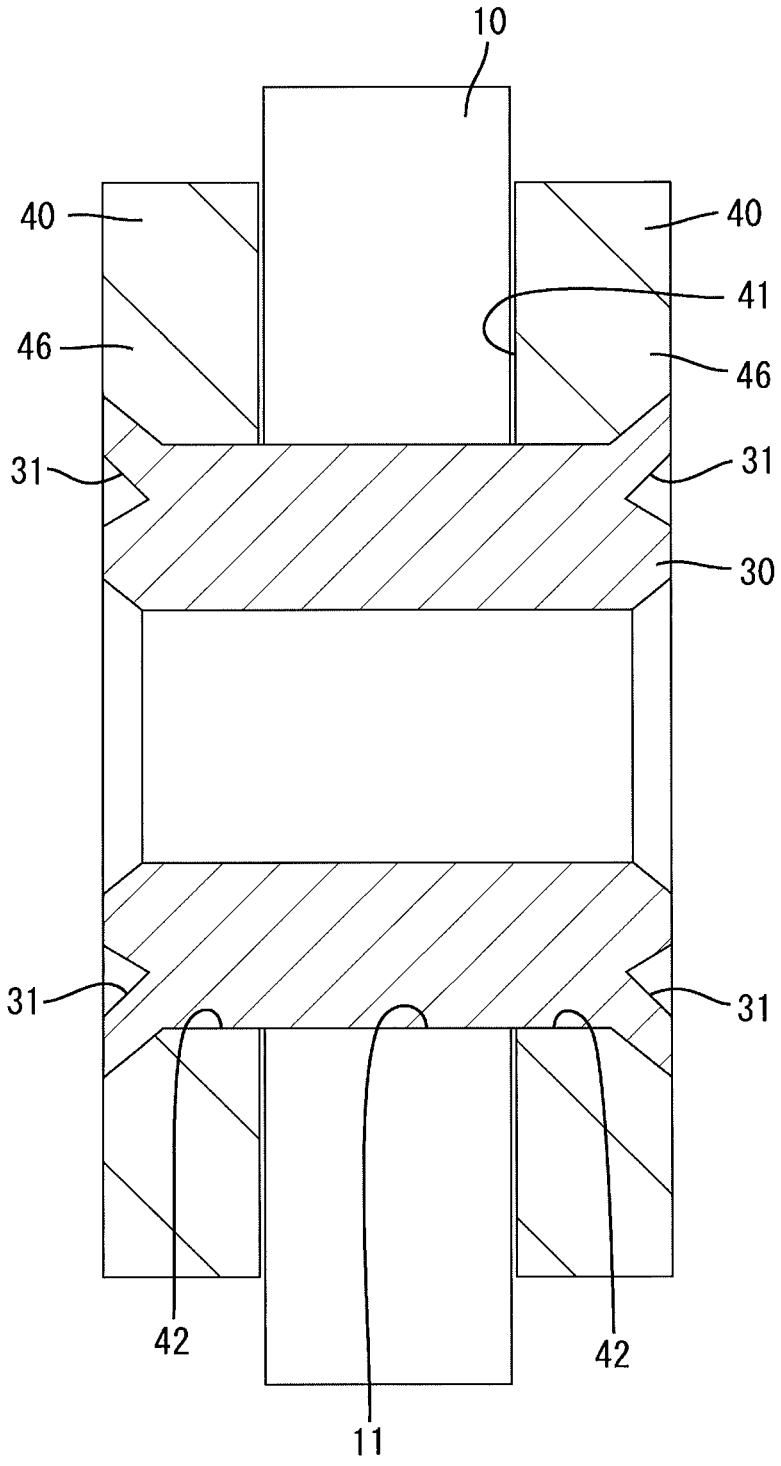
FIG. 3 is a sectional view taken along line X-X in FIG. 2.
Figure 4:
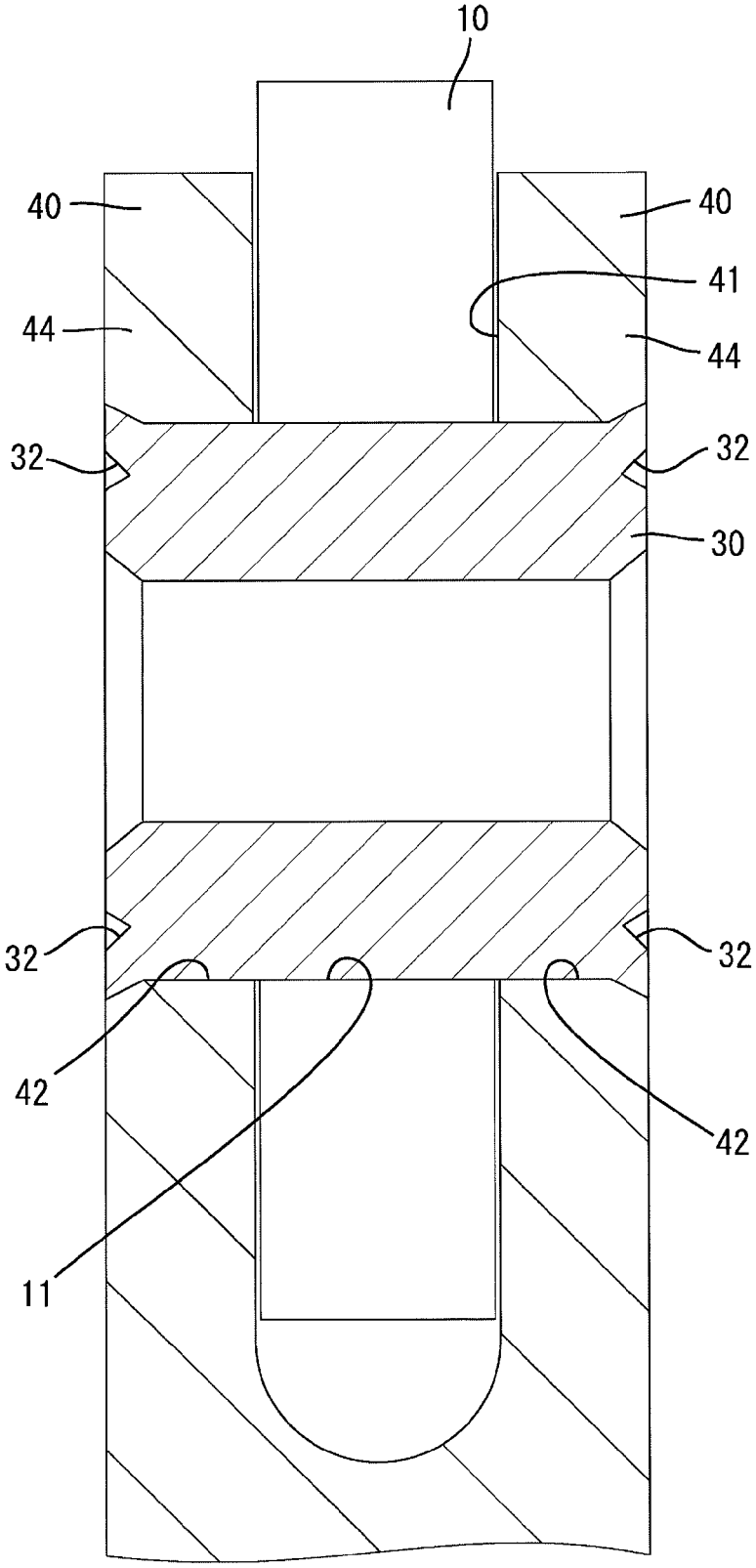
FIG. 4 is a sectional view taken along line Y-Y in FIG. 2.

The arm body 61 has a front end which protrudes forward in the form of a cantilever thereby to be formed into a pair of support walls 40. The support walls 40 are each formed into a flat plate shape and disposed so as to be substantially in parallel with each other as shown in FIG. 3. An accommodation space 41 is defined between the support walls 40. The accommodation space 41 is open frontward, upward and downward. The roller 10 is accommodated in the accommodation space 41 so as to be interposed between the support walls 40.

Figure 2:
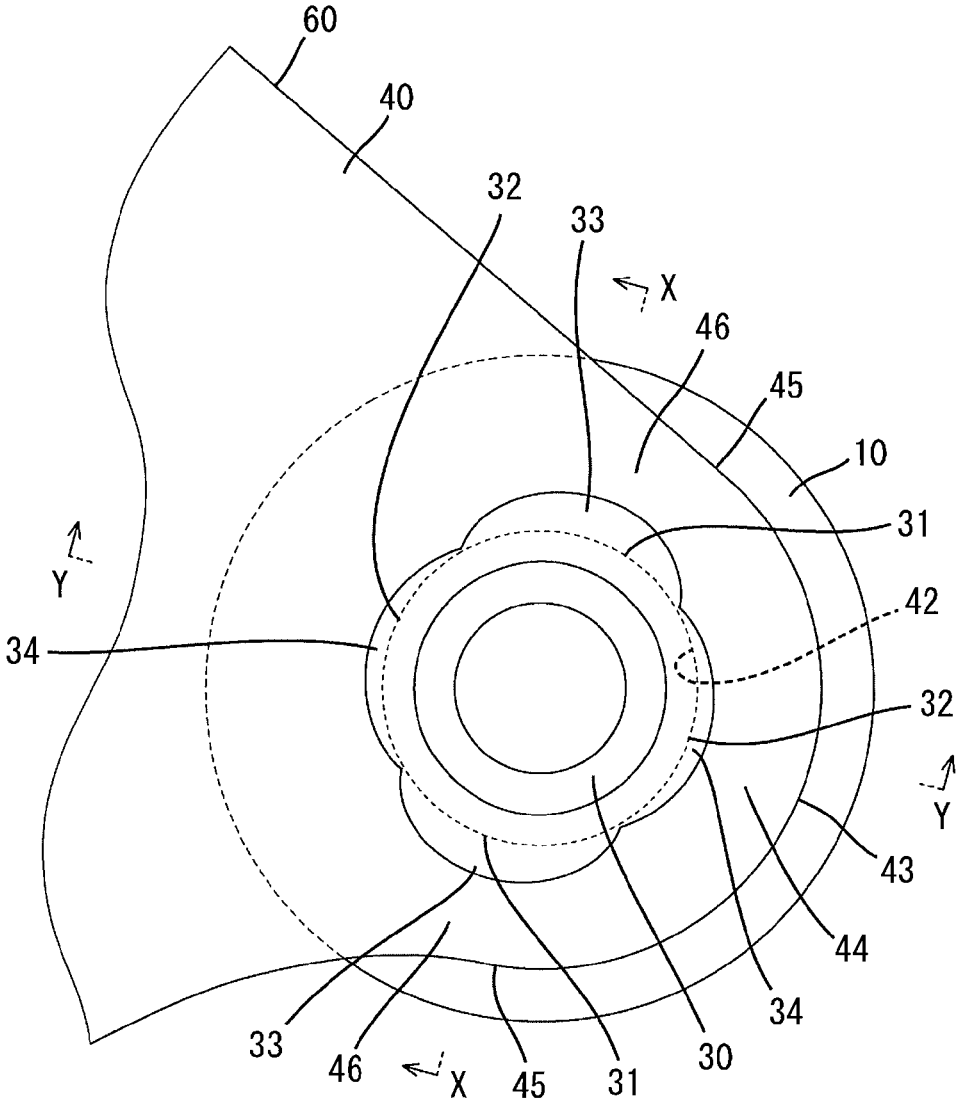
FIG. 2 is a side elevation of the supporting structure.

Both support walls 40 have respective through shaft holes 42 extending coaxially in the right-left direction. The support walls 40 have distal ends including generally arc-shaped peripheral edges concentric with the shaft holes 42, respectively, as shown in FIG. 2. The roller 10 includes a peripheral edge which is located outside the arc-shaped peripheral edges of the support walls 40 to be exposed. In more detail, each support wall 40 has an easily-deformable portion 44 located between a distal peripheral edge 43 of each support wall 40 in the protruding direction of each support wall 40 and a peripheral hole edge of the shaft hole 42 opposed to the aforementioned distal peripheral edge 43. Each easily-deformable portion 44 has a smaller section modulus due to a short radial cross-sectional shape thereof with respect to the shaft hole 42. Each support wall 40 further has a plurality of, for example, two hardly-deformable portions 46 which are hard to deform and are located between two outer edges 45 extending substantially along the protruding direction of each support wall 40 and the peripheral hole edge of the shaft hole 42 opposed to the outer edges. Each hardly-deformable portion 46 has a larger section modulus due to a long radial cross-sectional shape thereof with respect to the shaft hole 42.

The roller 10 is formed into an axially (in the right-left direction) short cylindrical shape and has a shaft hole 11 which coaxially communicates with the shaft holes 42 of the support walls 40, as shown in FIG. 3. The roller 10 has an inner circumferential surface on which is mounted a needle bearing (not shown) having a central hole in which a shaft member 30 is fitted. The shaft member 30 is formed into an axially (in the right-left direction) elongated cylindrical shape and includes an axially middle portion on which the roller 10 is rotatably supported. The shaft member 30 has two axial ends fitted in the shaft holes 42 of the support walls 40 respectively.

The shaft member 30 has two axial end surfaces which face outer surfaces of the support walls 40 and include a periphery which is configured to be circumferentially divided into a plurality of swaging portions 31 and 32. Each of the swaging portions 31 and 32 has an impression formed into the shape of a groove having a predetermined depth by the action of a swaging punch 20. More specifically, the swaging portions 31 and 32 include first arc-shaped swaging portions 31 (see FIG. 3) having deep grooves located opposite the hardly-deformable portions 46 of both support walls 40 and second arc-shaped swaging portions 32 (see FIG. 4) having shallow grooves located opposite the easily-deformable portions 44 of both support walls 40, respectively. The first and second swaging portions 31 and 32 are disposed so as to be paired at both radial sides between which the shaft holes 42 are interposed, respectively. The first and second swaging portions 31 and 32 are circumferentially continuous almost without discontinuity, whereby the first and second swaging portions 31 and 32 are each formed into an annular shape as a whole.

Furthermore, the shaft member 30 has both axial ends including regions corresponding to the swaging portions 31 and 32 respectively as shown in FIG. 2. The regions are deformed so as to be expanded with execution of a swaging process and will hereafter be referred to as corresponding regions 33 and 34 of the swaging portions 31 and 32 respectively. The corresponding regions 33 and 34 have respective outer peripheral edges which are formed into a petaline shape as a whole, which shape differs from a continuous circular shape. The corresponding region 33 of the first swaging portion 31 is expanded larger radially outward than the corresponding region 34 of the second swaging portion 32.

Thus, each first swaging portion 31 has a deeper groove than each second swaging portion 32, and the corresponding regions 33 of each first swaging portion 31 is expanded larger than the corresponding regions 34 of each second swaging portion 32. The reason for these phenomena is that a larger swage load is applied to each first swaging portion 31 than to each second swaging portion 32.

Figure 5:
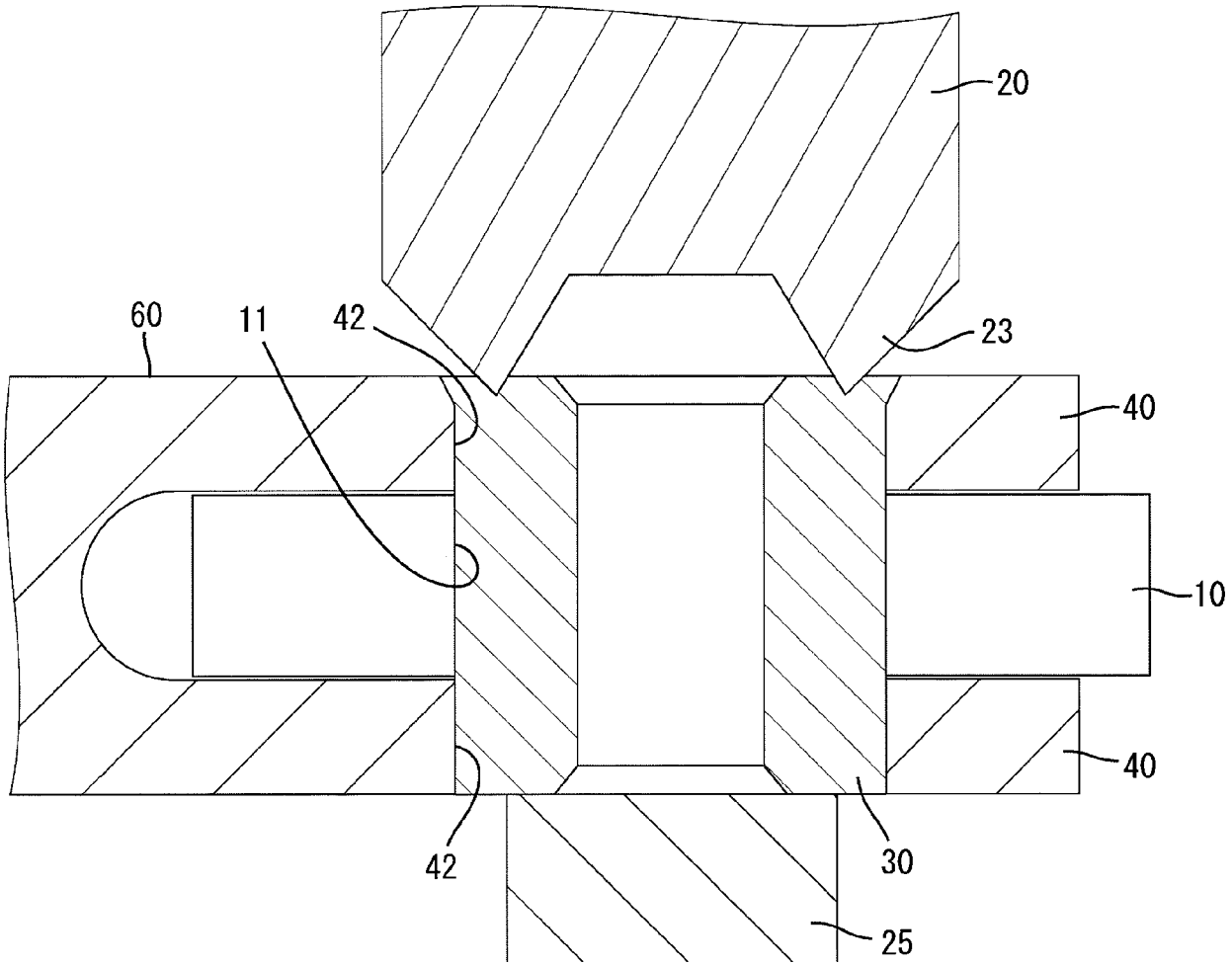
FIG. 5 is a sectional view showing the state where a punch has been driven into one of both ends of the shaft.
Figure 6:
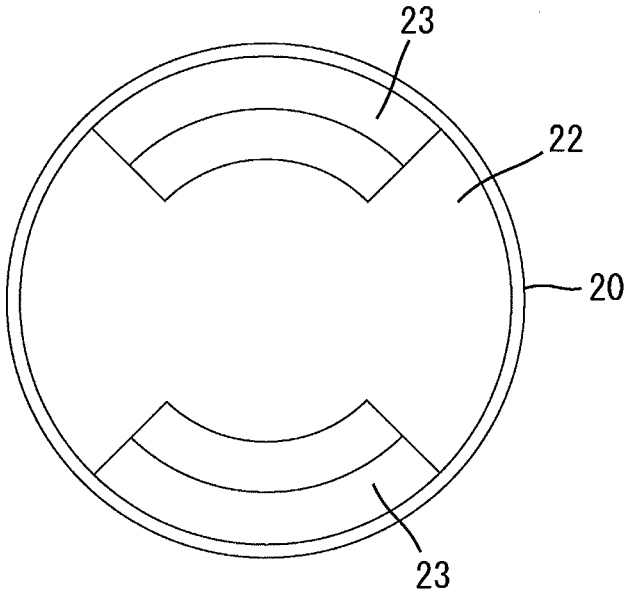
FIGS. 6A and 6B are enlarged views of distal ends of a swaging jig.
Figure 6:
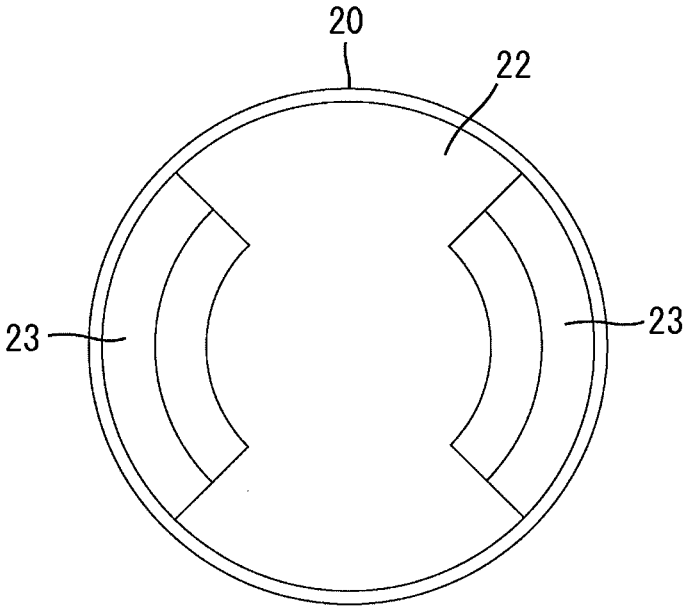

A method of manufacturing the supporting structure for the roller 10 will now be described. Firstly, the roller 10 is placed between the support walls 40 and in this state, the shaft member 30 is inserted through the shaft holes 42 of the support walls 40 and the shaft hole 11 of the roller 10, whereupon both axial ends of the shaft member 30 face outer surfaces of the support walls 40 respectively. In this state, the punch 20 is driven to the respective peripheries of both axial end surfaces of the shaft member 30 as shown in FIG. 5. In the case as shown in FIG. 5, the shaft member 30 is axially held between the punch 20 and the bearer 25. However, a pair of punches 20 may be used to hold the shaft member 30 therebetween, instead. Furthermore, the punch 20 used in the swaging process has a distal end 21 formed with a pair of arc-shaped protrusions 23 disposed symmetrically about the center of the distal end 21 as shown in FIGS. 6A and 6B.

When the punch 20 is driven forward in the above-described swaging process, the protrusion 23 thereof acts on the first swaging portions 31 of the end surface periphery of the shaft member 30 such that the corresponding regions 33 of the respective first swaging portions 31 are deformed so as to be spread. The spread portions are secured in the shaft hole 42. Successively, the punch 20 or the bearer 25 is angularly displaced by 90° about the axis (see FIGS. 6A to 6B). The punch 20 is also driven forward from the position after the angular displacement. As a result, the protrusion 23 of the punch 20 acts on the second swaging portions 32 of the end surface periphery of the shaft member 30 such that the corresponding regions 34 of the second swaging portion 32 are deformed so as to be spread. The spread portions are secured in the shaft hole 42. Alternatively, the second swaging portions 32 may first be swaged, instead. Furthermore, a larger swage load is applied to the first swaging portions 31 than to the second swaging portions 32.

By executing the swaging process twice, the swage load applied to each swaging portion per process can be reduced as compared with the case where the swaging process is executed only once. Furthermore, a predetermined strained force to be applied to the support walls 40 can be obtained even when the applied swage load is reduced as described above, and impressions with predetermined depths are formed on the first and second swaging portions 31 and 32 respectively. Accordingly, deformation forces to be transmitted from the respective swaging portions 31 and 32 to the support walls 40 are reduced as compared with the case where a large swage load is applied to both end peripheries of the shaft member by a conventional one-time swaging process. Consequently, both support walls 40 can be prevented from deformation without complicating an entire construction even when each support walls 40 has an existing construction. In particular, a larger swage load is applied to the first swaging portions 31 located opposite the respective hardly-deformable portions 46 of the support walls 40 than to the second swaging portions 32 located opposite the respective easily-deformable portions 44 of the support walls 40. Consequently, deformation of the easily-deformable portions 44 can reliably be suppressed, and a necessary swage strength can reliably be obtained as a whole.

Moreover, the corresponding regions 33 and 34 of the first and second swaging portions 31 and 32 have respective outer peripheral edges formed into the petaline shape differing from the continuous circular shape. This can suppress rotation of the shaft member 30 about the axis thereof and can improve the stability in the holding of the shaft member 30 between the support walls 40. Furthermore, since the protrusion 23 of the swaging jig is formed into the arc-shape along the swaging portions 31 and 32, the swaging portions 31 and 32 are circumferentially continuous such that a generally annular impression can be obtained as in the conventional art.

The foregoing embodiment may be modified or expanded as follows. Three or more swaging portions may circumferentially be formed on both axial end peripheries of the shaft member so that the swaging process is executed three times or more.

The same swage load may be applied both to the first swaging portions opposite to the respective hardly-deformable portions and to the second swaging portions opposite to the respective easily-deformable portions.

Different punches may be prepared for the swaging portions and the work may be moved relative to the punches for execution of swaging.

The shaft member may be a solid column.

The above-described construction may be applied to a supporting structure for a roller of a lifter in a fuel pump other than the rocker arm.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

What is claimed is:

1. A method of manufacturing a supporting structure comprising:

disposing a supported member between a pair of support walls opposed to each other, the support walls and the supported member having shaft holes formed coaxially through the support walls and the supported member respectively;

inserting a shaft member through the shaft holes in the disposed state, the shaft member having two ends each of which has a peripheral portion circumferentially divided into a plurality of swaging portions continuous without discontinuity; and swaging the swaging portions sequentially such that regions of the shaft member corresponding to the respective swaging portions are fixed in the shaft holes of the respective support walls, wherein:

the swaging portions include first swaging portions and second swaging portions, both of which are disposed so as to be paired at both radial sides of the shaft holes, respectively;

and a larger swage load is applied to each first swaging portion than to each second swaging portion.

2. The method according to claim 1, wherein the support walls have respective hardly-deformable portions and respective easily-deformable portions having shorter distances from peripheral edges of the support walls to the shaft holes and smaller section modulus than the hardly-deformable portions, and a swage load applied to the first swaging portions located opposite the hardly-deformable portions is larger than a swage load applied to the second swaging portions located opposite the easily-deformable portions, respectively.

3. A swaging jig which is used in the method of manufacturing the supporting structure defined in claim 1, the swaging jig having a pair of protrusions to form the swaging portions, the protrusions being each formed into an arc shape.

4. A supporting structure comprising:

a pair of support walls opposed to each other with a supported member being interposed therebetween, the support walls and the supported member having shaft holes formed coaxially through the support walls and the support member respectively; and a shaft member inserted through the respective shaft holes of the support walls and the supported member, wherein:

the shaft member has two ends each of which has a peripheral portion circumferentially divided into a plurality of swaging portions which are sequentially swaged such that regions of the shaft member corresponding to the respective swaging portions are fixed in the shaft holes of the respective support walls; and the corresponding regions of the swaging portions have outer peripheral edges which are formed into shapes differing from a complete circle over entire circumferences, respectively;

the swaging portions include first swaging portions and second swaging portions, both of which are disposed so as to be paired at both radial sides of the shaft holes, respectively; and each first swaging portion has an impression of a groove deeper than each second swaging portion.

5. The supporting structure according to claim 4, wherein the support walls have respective hardly-deformable portions and respective easily-deformable portions having shorter distances from peripheral edges of the support walls to the shaft holes and smaller section modulus than the hardly-deformable portions, and each first swaging portion located opposite the hardly-deformable portion has an impression of a groove deeper than each second swaging portion located opposite the easily-deformable portion.

* * * * *